US011033768B2

(12) United States Patent
Chuang

(10) Patent No.: US 11,033,768 B2
(45) Date of Patent: Jun. 15, 2021

(54) RESTORING MECHANISM AND EXERCISING DEVICE

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 45 days.

(21) Appl. No.: 16/357,310

(22) Filed: Mar. 18, 2019

(65) Prior Publication Data

US 2020/0061406 A1 Feb. 27, 2020

(30) Foreign Application Priority Data

Aug. 24, 2018 (CN) ..... 201821371905.X

(51) Int. Cl.
*A63B 21/00* (2006.01)
*A63B 21/22* (2006.01)
*A63B 22/20* (2006.01)

(52) U.S. Cl.
CPC ..... *A63B 21/00181* (2013.01); *A63B 21/22* (2013.01); *A63B 21/4035* (2015.10); *A63B 22/20* (2013.01)

(58) Field of Classification Search
CPC ... A63B 21/00181; A63B 21/00; A63B 21/02; A63B 21/045; A63B 21/068; A63B 21/22; A63B 21/4035; A63B 22/20; A63B 23/02; A63B 23/00; A63B 2210/50; A63B 2208/0228; A63B 2208/0204; A63B 2208/0219
See application file for complete search history.

(56) References Cited

U.S. PATENT DOCUMENTS 6,544,153 B2 * 4/2003 Lee ..... A63B 21/0004 482/127
7,951,052 B1 * 5/2011 Tang ..... A63B 22/20 482/132
9,011,303 B2 * 4/2015 MacColl ..... A63B 21/023 482/132
2013/0281270 A1 * 10/2013 Chen ..... A63B 21/025 482/132
2016/0101314 A1 * 4/2016 Exley ..... A63B 21/0455 482/132
2020/0298054 A1 * 9/2020 Manion ..... A63B 5/20

* cited by examiner

*Primary Examiner* — Megan Anderson
(74) *Attorney, Agent, or Firm* — CKC & Partners Co., LLC

(57) ABSTRACT

A restoring mechanism for providing a restoring force to an exercising device which includes a fixing structure and a wheel is provided. The restoring mechanism includes a restoring set, a driving set and a connecting set. The restoring set includes a fixed portion and a link-up portion. The fixed portion is connected to the fixing structure. The driving set is connected to the link-up portion. The connecting set is selectively coupled to the driving set. When the connecting set is coupled to the driving set, rotation of the wheel causes the driving set to drive the restoring set such that the restoring set is allowed to accumulate energy.

13 Claims, 15 Drawing Sheets

RESTORING MECHANISM AND EXERCISING DEVICE

RELATED APPLICATIONS

This application claims priority to CN Application Serial Number 201821371905.X, filed Aug. 24, 2018, which is herein incorporated by reference.

BACKGROUND

Technical Field

The present disclosure relates to a restoring mechanism and an exercising device. More particularly, the present disclosure relates to a restoring mechanism and an exercising device including a restoring force which can be selectively disabled.

Description of Related Art

Owing to the benefit of exercising, a lot of exercising devices are developed. Some of then can do reciprocated training to train the abdomen, the waist, the hip and/or the arm. In addition, the muscle can be stretched and the health can be improved.

A conventional reciprocated exercising device, such as an abdominal exercising device, includes two handles, a wheel and a restoring mechanism. The handles are connected to the wheel, and the restoring mechanism disposed inside the wheel can have a spring structure. When the wheel is rotated in a clockwise direction to compress the restoring mechanism, the restoring mechanism can be restored to assist the user to return to his/her original posture if the wheel is rotated in the counter clockwise direction. Similarly, when the wheel is rotated in the counter clockwise direction to compress the restoring mechanism, the restoring mechanism can be restored to assist the user to return to his/her original posture if the wheel is rotated in the clockwise direction.

However, the restoring mechanism in such a conventional reciprocated exercising device cannot be disabled. If the user needs an exercising device without the restoring force, he/she has to buy another exercising device. The usage of the exercising device is limited.

Therefore, based on the abovementioned problems, how to effectively improve the structure of the exercising device to allow the exercising device has wide usage becomes a pursuit target for the practitioners.

SUMMARY

A restoring mechanism for providing a restoring force to an exercising device which includes a fixing structure and a wheel is provided. The restoring mechanism includes a restoring set, a driving set and a connecting set. The restoring set includes a fixed portion and a link-up portion. The fixed portion is connected to the fixing structure. The driving set is connected to the link-up portion. The connecting set is selectively coupled to the driving set. When the connecting set is coupled to the driving set, rotation of the wheel causes the driving set to drive the restoring set such that the restoring set is allowed to accumulate energy.

An exercising device is provided. The exercising device includes a fixing structure, one or more wheels and one or more restoring mechanisms disposed at the fixing structure. The one or more restoring mechanisms each includes a restoring set, a driving set, and a connecting set. The restoring set includes a fixed portion and a link-up portion. The fixed portion is connected to the fixing structure. The driving set is connected to the link-up portion. The connecting set is selectively coupled to the driving set. When the connecting set is coupled to the driving set, rotation of the one or more wheels causes the driving set to drive the restoring set such that the restoring set is allowed to accumulate energy.

BRIEF DESCRIPTION OF THE DRAWINGS

The disclosure can be more fully understood by reading the following detailed description of the embodiments, with reference made to the accompanying drawings as follows.

DETAILED DESCRIPTION

It will be understood that when an element (or mechanism or module) is referred to as be "disposed on", "connected to" or "coupled to" another element, it can be directly disposed on, connected or coupled to the other element, or it can be indirectly disposed on, connected or coupled to the other element, that is, intervening elements may be present. In contrast, when an element is referred to as be "directly disposed on," "directly connected to" or "directly coupled to" another element, there are no intervening elements present.

In addition, the terms first, second, third, etc. is used herein to describe various elements or components, these elements or components should not be limited by these terms. Consequently, a first element or component discussed below could be termed a second element or component.

Figure 1:
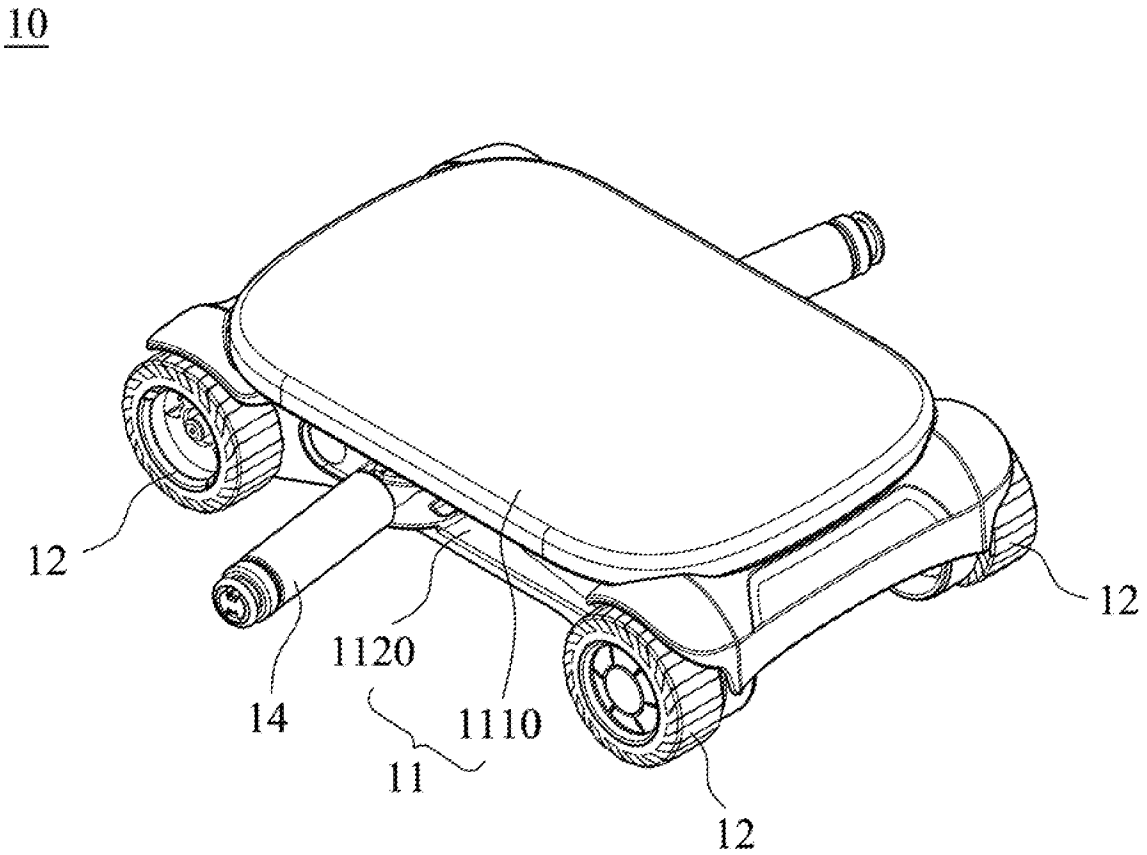
FIG. 1 shows a schematic three-dimensional view of an exercising device according to one embodiment of the present disclosure.
Figure 2:
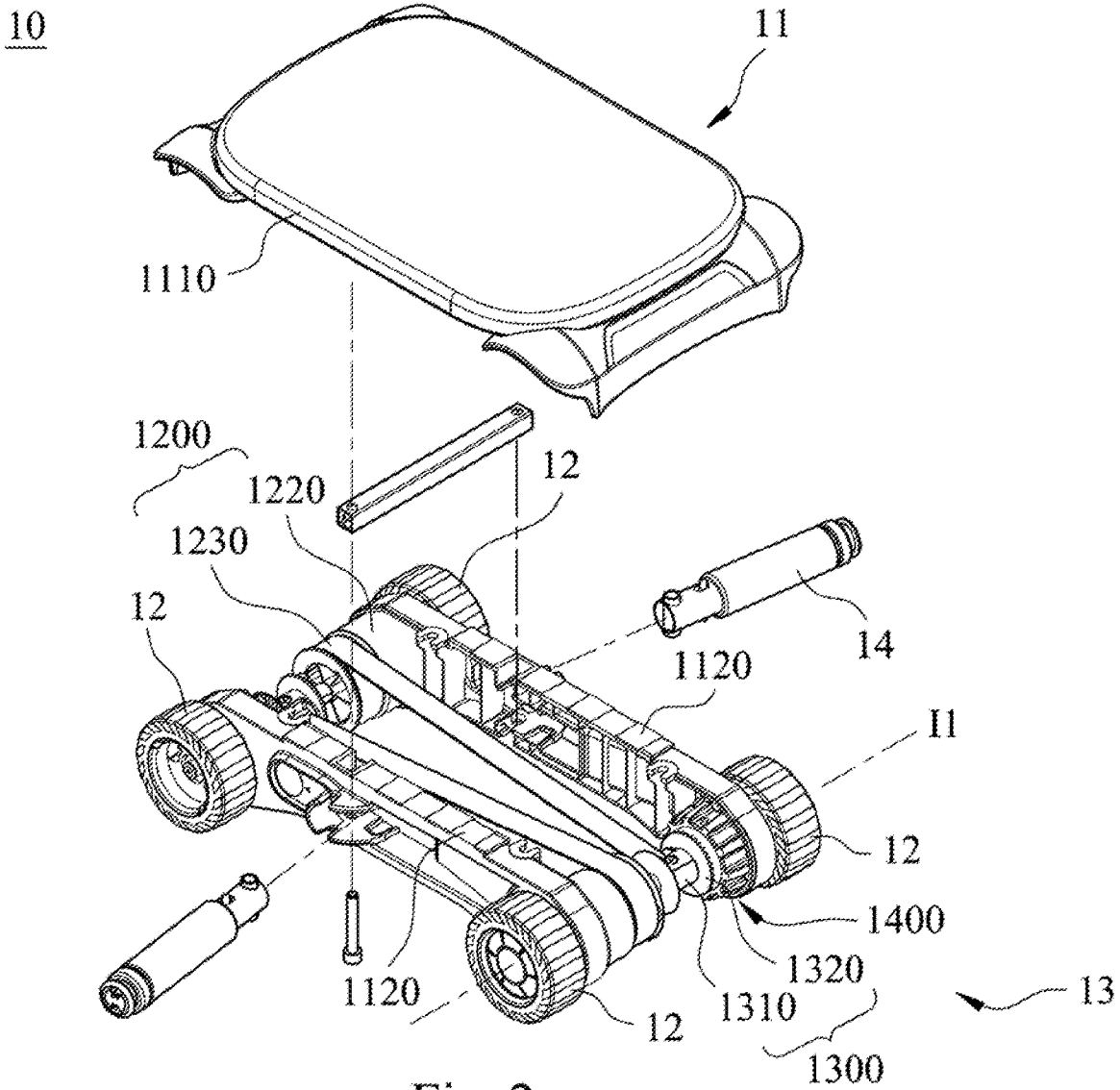
FIG. 2 shows an exploded view of the exercising device of FIG. 1.
Figure 3:
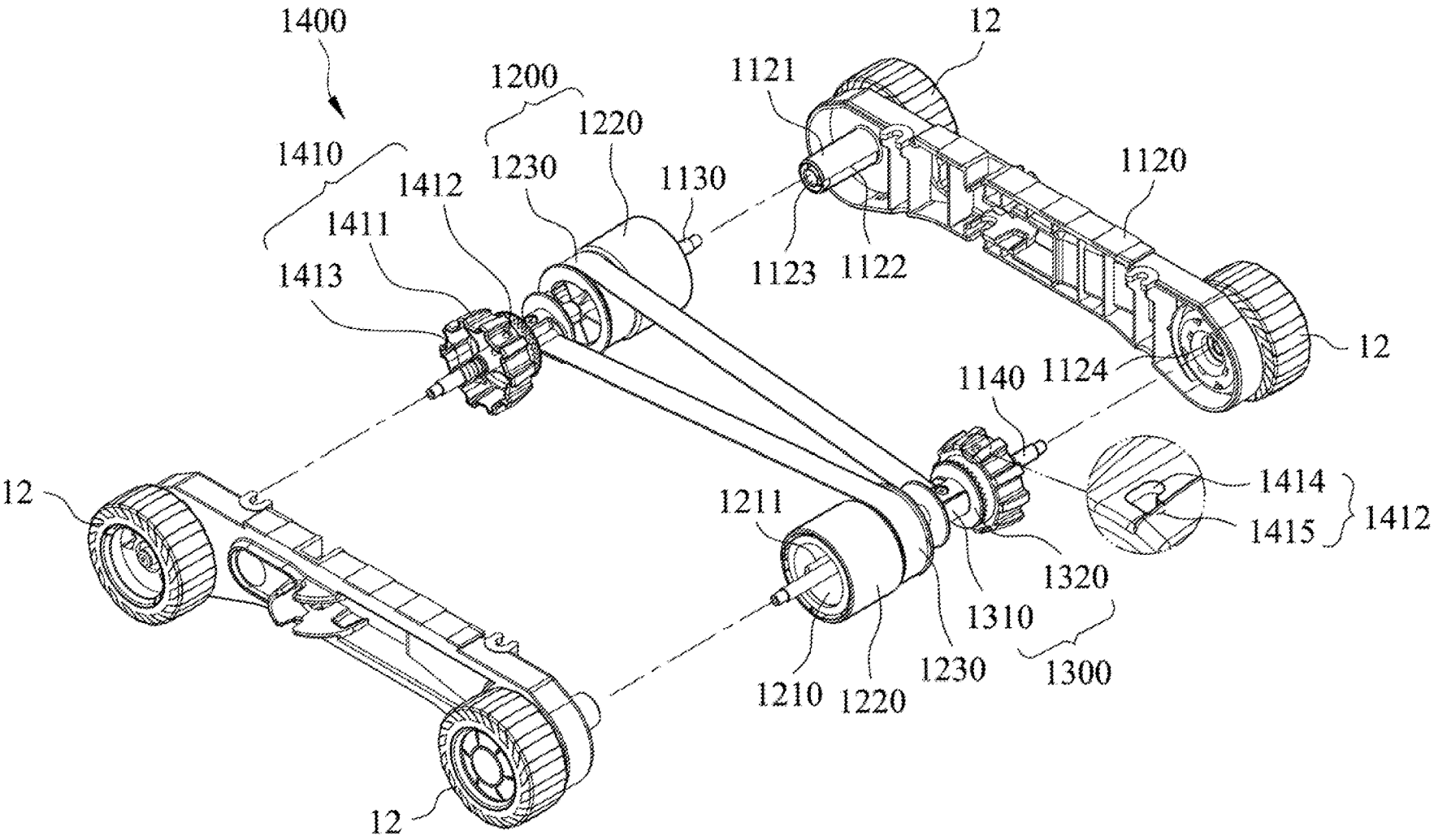
FIG. 3 shows one partial exploded view of the exercising device of FIG. 1.
Figure 4:
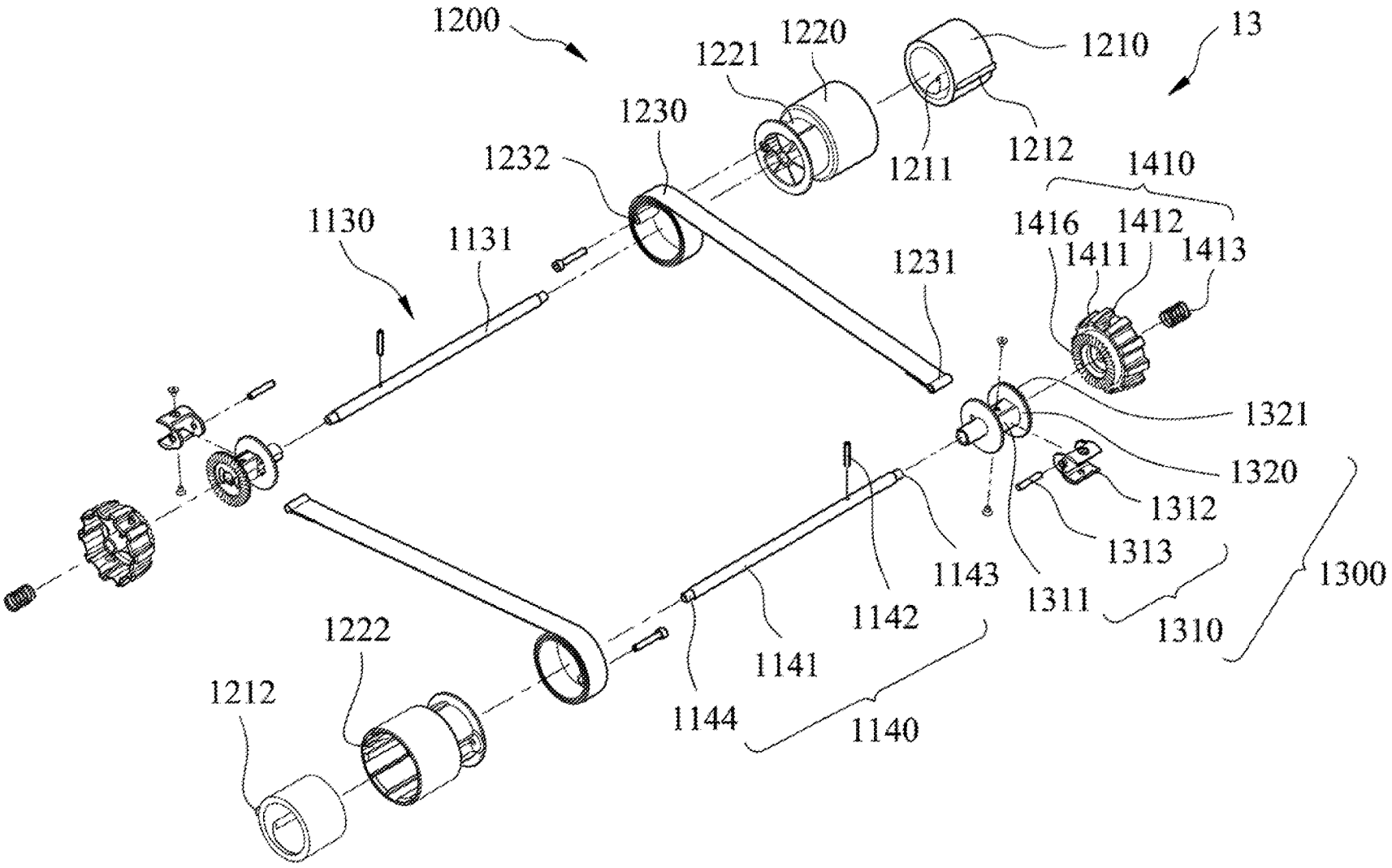
FIG. 4 shows another partial exploded view of the exercising device of FIG. 1.
Figure 5B:
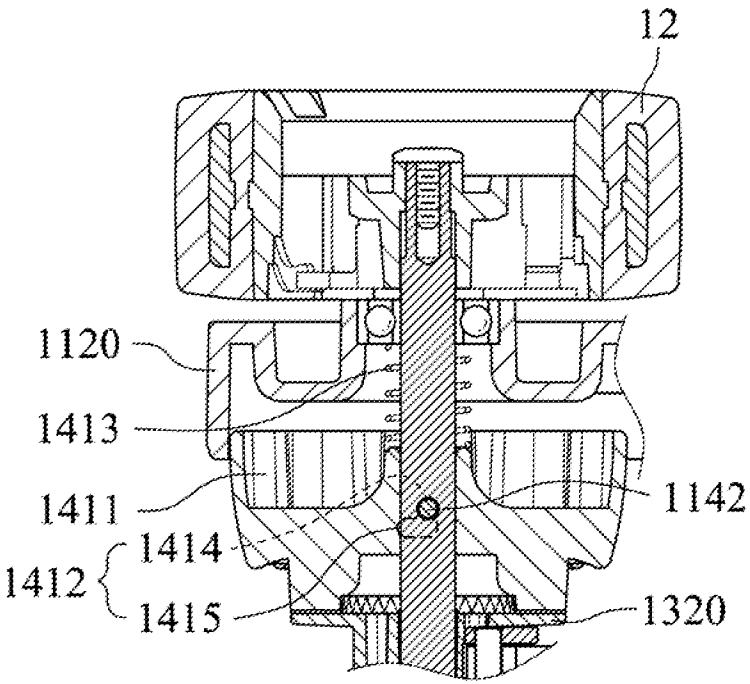
FIG. 5B shows another partial enlarged cross-sectional view of the exercising device of FIG. 1.
Figure 5A:
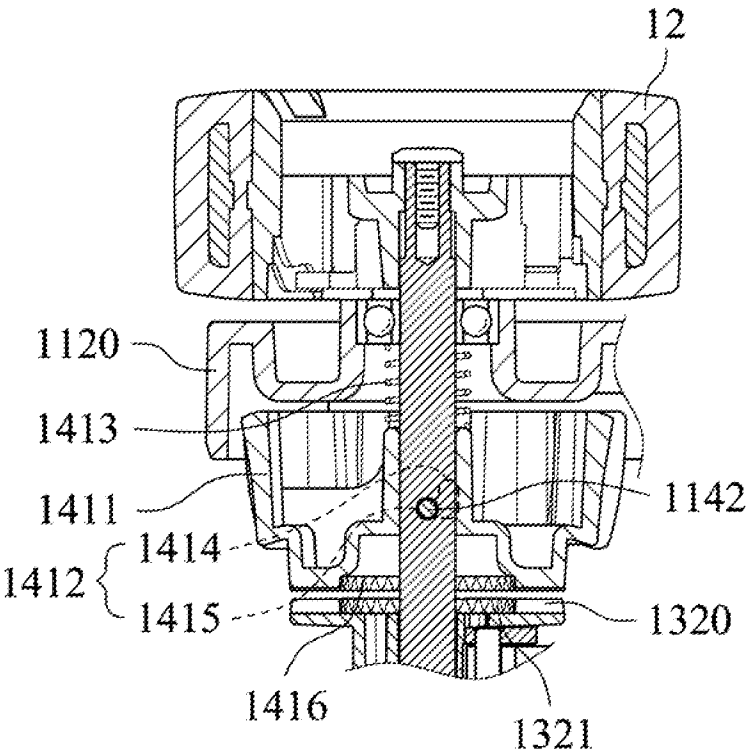
FIG. 5A shows one partial enlarged cross-sectional view of the exercising device of FIG. 1.

FIG. 1 shows a schematic three-dimensional view of an exercising device 10 according to one embodiment of the present disclosure. FIG. 2 shows an exploded view of the exercising device 10 of FIG. 1. FIG. 3 shows one partial exploded view of the exercising device 10 of FIG. 1. FIG. 4 shows another partial exploded view of the exercising device 10 of FIG. 1. FIG. 5A shows one partial enlarged cross-sectional view of the exercising device 10 of FIG. 1. FIG. 5B shows another partial enlarged cross-sectional view of the exercising device 10 of FIG. 1. The exercising device 10 includes a fixing structure 11, one or more wheels 12 and one or more restoring mechanisms 13.

The one or more wheels 12 are disposed at the fixing structure 11, and the one or more restoring mechanisms 13 are disposed at the fixing structure 11 and each includes a restoring set 1200, a driving set 1300, and a connecting set 1400. The restoring set 1200 includes a fixed portion 1211 and a link-up portion 1231. The fixed portion 1211 is connected to the fixing structure 11. The driving set 1300 is connected to the link-up portion 1231. The connecting set 1400 is selectively coupled to the driving set 1300. When the connecting set 1400 is coupled to the driving set 1300, rotation of the one or more wheels 12 causes the driving set 1300 to drive the restoring set 1200 such that the restoring set 1200 is allowed to accumulate energy.

Therefore, since the restoring set 1200 can selectively accumulate energy to provide a restoring force, the exercising device 10 including the one or more restoring mechanisms 13 can have different operation effects, and the usage thereof can be even changed.

The exercising device 10 of FIG. 1 further includes a carrier 1110, two frames 1120, a first axle 1130 and a second axle 1140. The two frames 1120 are disposed at two sides of the carrier 1100. The first axle 1130 and the second axle 1140 are spaced apart from each other, and each of the first axle 1130 and the second axle 1140 is connected between the two frames 1120. A number of the one or more wheels 12 is four, and two of the wheels 12 are disposed at the first axle 1130. The other two of the wheels 12 are disposed at the second axle 1140, and the fixed portion 1211 of the restoring set 1200 is connected to one of the frames 1120.

The restoring set 1200 can further include a spiral spring 1210 with the fixed portion 1211, a spring sleeve 1220 and a belt 1230 with the link-up portion 1231. The spiral spring 1210 is disposed at the first axle 1130 and further includes a jointed portion 1212. The spring sleeve 1220 covers the spiral spring 1210 and is connected to the jointed portion 1212. The belt 1230 is wound around the spring sleeve 1220. The driving set 1300 can include a spool 1310 and an engaging plate 1320. The spool 1310 is disposed at the second axle 1140 and is connected to the link-up portion 1231. The spool 1310 is configured for the belt 1230 to wind therearound. The engaging plate 1320 is connected to one end the spool 1310 and includes an engaging portion 1321. The connecting set 1400 includes a mounting assembly 1410. The mounting assembly 1410 is disposed at the second axle 1140 and is connected to the wheels 12 which are disposed at the second axle 1140. The mounting assembly 1410 includes a mounting portion 1416 selectively coupled to the engaging portion 1321. The mounting portion 1416 switches between a first position and a second position in an axial direction I1 of one of the two wheels 12. When the mounting portion 1416 is located at the first position, the mounting portion 1416 is coupled to the engaging portion 1321, and rotation of the two wheels 12 that are disposed at the second axle 1140 causes the belt 1230 to wind on the spool 1310 such that the spiral spring 1210 is allowed to accumulate energy. When the mounting portion 1416 is located at the second position, the two wheels 12 that are disposed at the second axle 1140 do not link up with the driving set 1300. The mounting portion 1416 can include a plurality of protruding teeth, and the engaging portion 1321 can include a plurality of depressions corresponding to the protruding teeth.

The second axle 1140 includes an axle body 1411 and a positioning pin 1142. Two ends 1143, 1144 of the axle body 1141 are connected to two of the wheels 12, respectively. The positioning pin 1142 is protrudingly disposed at the axle body 1141 in a radial direction (not shown) of one of the two wheels 12, that is, the radial direction perpendicular to the axial direction I1. The mounting assembly 1410 further includes a revolvable member 1411 with the mounting portion 1416 and a limiting portion 1412. The limiting portion 1412 is positioned at the revolvable member 1411 and is coupled to the positioning pin 1142. The limiting portion 1412 includes a first segment 1414 and a second segment 1415. When the positioning pin 1142 is located at the second segment 1415, the mounting portion 1416 is located at the second position and separated from the engaging portion 1321, and when the positioning pin 1142 is located at the first segment 1414, the mounting portion 1416 is located at the first position to engage with the engaging portion 1321.

The mounting assembly 1410 can further include a compression spring 1413 located between the revolvable member 1411 and the frame 1120. When the positioning pin 1142 is located at the second segment 1415, the revolvable member 1411 causes compression of the compression spring 1413, and the mounting portion 1416 is located at the second position and separated from the engaging portion 1321. When the positioning pin 1142 is located at the first segment 1414, the compression spring 1413 is restored to push the engaging plate 1320, and the mounting portion 1416 switches to the first position to engage with the engaging portion 1321.

Precisely, the carrier 1110 of the fixing structure 11 is configured for a user to rest, stand or sit thereon. Although carrier 1110 of the fixing structure 11 is rectangular-shaped, the carrier can be, but not limited to, circular-shaped or oval-shaped in other embodiment.

Each of the frames 1120 can include two axial holes 1124. The two holes 1120 can locate at two ends of each frame 1120, respectively, and the two holes 1120 are configured for the axle bodies 1131, 1141 of the first axle 1130 and the second axel 1140 to pass therethrough. The axle bodies 1131, 1141 can rotate relative to each frame 1120. Each frame 1120 can further include a hollow post 1121, a positioning groove 1122 and a clearance hole 1123. The hollow post 1121 is disposed at the frame 1120 in the axial direction I1. The clearance hole 1123 is positioned at the hollow post 1121 and is communicated with the axial hole 1124. The clearance hole 1123 is configured for each axle body 1131, 1141 to pass therethrough. The positioning groove 1122 is located at the hollow post 1121 and is connected to the fixed portion 1211.

The spring sleeve 1220 is tube-shaped and includes an annular track 1221 and a connecting groove 1222. The annular track 1221 is located at an outer surface (not labeled) of the spring sleeve 1220 and is configured for the belt 1230 to wind therearound. The connecting groove 1222 is located at an inner wall (not labeled) of spring sleeve 1220 and is configured for connecting the jointed portion 1212 of the spiral spring 1210. The belt with the link-up portion 1231 can further include an attaching portion 1232. The attaching portion 1232 is fixed at the spring sleeve 1220. The belt 1230 is non-elastic.

The spiral spring 1210 can cover an outer side of the hollow post 1121, and the spring sleeve 1220 can cover an outside of the spiral spring 1210. The fixed portion 1211 is connected to the positioning groove 1122, and the jointed portion 1212 is connected to the connecting groove 1222. The belt 1230 is wound around the annular track 1221. Therefore, when the belt 1230 is pulled to rotate the spring sleeve 1220, the spiral spring 1210 can deform and accumulate energy owing to the connection between the fixed portion 1211 of the spiral spring 1210 and the positioning groove 1122 of the frame 1120. Please be noted that, in other embodiment, the spring sleeve can be omitted, and the belt can directly connect to the jointed portion of the spiral spring such that movement of the belt can deform the spiral spring. The present disclosure will not be limited thereto.

The spool 1310 can include a shaft 1311, a clip 1312 and a peg 1313. The shaft 1311 is disposed the second axle 1140, and the clip 1312 is disposed at an outside of the shaft 1311. The peg 1313 is connected to the link-up portion 1231 and is pivotally disposed at the clip 1312. Hence, when the engaging portion 1321 of the engaging plate 1320 is coupled to the mounting portion 1416, the spool 1310 can rotate to allow the belt 1230 to wind therearound no matter the wheel 12 is rotated in the clockwise direction or in the counter clockwise direction such that the restoring set 1200 can accumulate energy.

The connecting set 1400 is selectively coupled to the driving set 1300. In the exercising device 10 of FIG. 1, the connecting set 1400 is composed of the mounting assembly 1410. The revolvable member 1411 includes a hole (not labeled) which is communicated with the limiting portion 1412. The limiting portion 1412 has a L-shaped hole structure, and the limiting portion 1412 includes a first segment 1414 and a second segment 1415 connected to each other to form the L-shaped hole structure. The first segment 1414 is extended in the axial direction I1, and the second segment is extended in the radial direction. After the axle body 1141 of the second axel 1140 passes through the hole, the positioning pin 1142 protrudes into the limiting portion 1412 and is limitedly movable in the limiting portion 1412. Based on the coupling relation between the limiting portion 1412 and the positioning pin 1142, rotation of the wheel 12 can cause rotation of the second axle 1140 such that the revolvable member 1141 will also rotate.

Hence, as shown in FIG. 5A, when the positioning pin 1142 is located in the second segment 1415, the mounting portion 1416 is located at the second position and separated from the engaging portion 1321, and the revolvable member 1411 compresses the compression spring 1413 to allow the compression spring 1413 to accumulate energy. Because the mounting portion 1416 is separated from the engaging portion 1321, rotation of the wheel 12 cannot cause rotation of the spool 1310; as a result, the belt 1230 cannot be wound or released and the restoring set 1200 cannot accumulate energy such that no restoring force can be provided. On the other hand, as shown in FIG. 5B, when rotation of the revolvable member 1411 causes the positioning pin 1142 to switch from the second segment 1415 to the first segment 1414, the mounting portion 1416 is switched to the first position and engaged with the engaging portion 1321. Based on the engagement between the mounting portion 1416 and the engaging portion 1321, rotation of the wheel 12 can cause rotation of the spool 1310 such that the belt 1230 is allowed to be wound or released, and the restoring set 1200 can accumulate energy to provide the restoring force.

In other embodiment, the position of the first segment and the second segment can be changed, and the compression spring can be located between the revolvable wheel and the engaging plate. Under such structure, when the positioning pin is located at the second segment, the mounting portion is located at the first position to couple to the engaging portion and compresses the compression spring. On the other hand, when rotation of the revolvable wheel causes the positioning pin to be located at the first segment, the compression spring is restored to push the revolvable member away from the engaging plate such that the mounting portion is switched to the second position and separated from the engaging portion. The present disclosure is not limited thereto.

The exercising device 10 of the FIG. 1 can further include two handles 14 pivotally disposed at the fixing structure 11. Precisely, the two handles 14 are pivotally disposed at the two frame 1120, respectively. Since each handle 14 is pivotally disposed at each frame 1120, the handle 14 is rotatable relative to the frame 1120. Additionally, a number of the restoring mechanisms 13 is two. The driving set 1300 of one of the restoring mechanisms 13 is disposed at the first axle 1130, and the driving set 1300 of the other one of the restoring mechanisms 13 is disposed at the second axle 1140. In other words, the two restoring mechanisms 13 are arranged oppositely. Such arrangement can increase the restoring force and the loads of all the elements are balanced. In other embodiment, a number of the restoring mechanism can be one.

Figure 6:
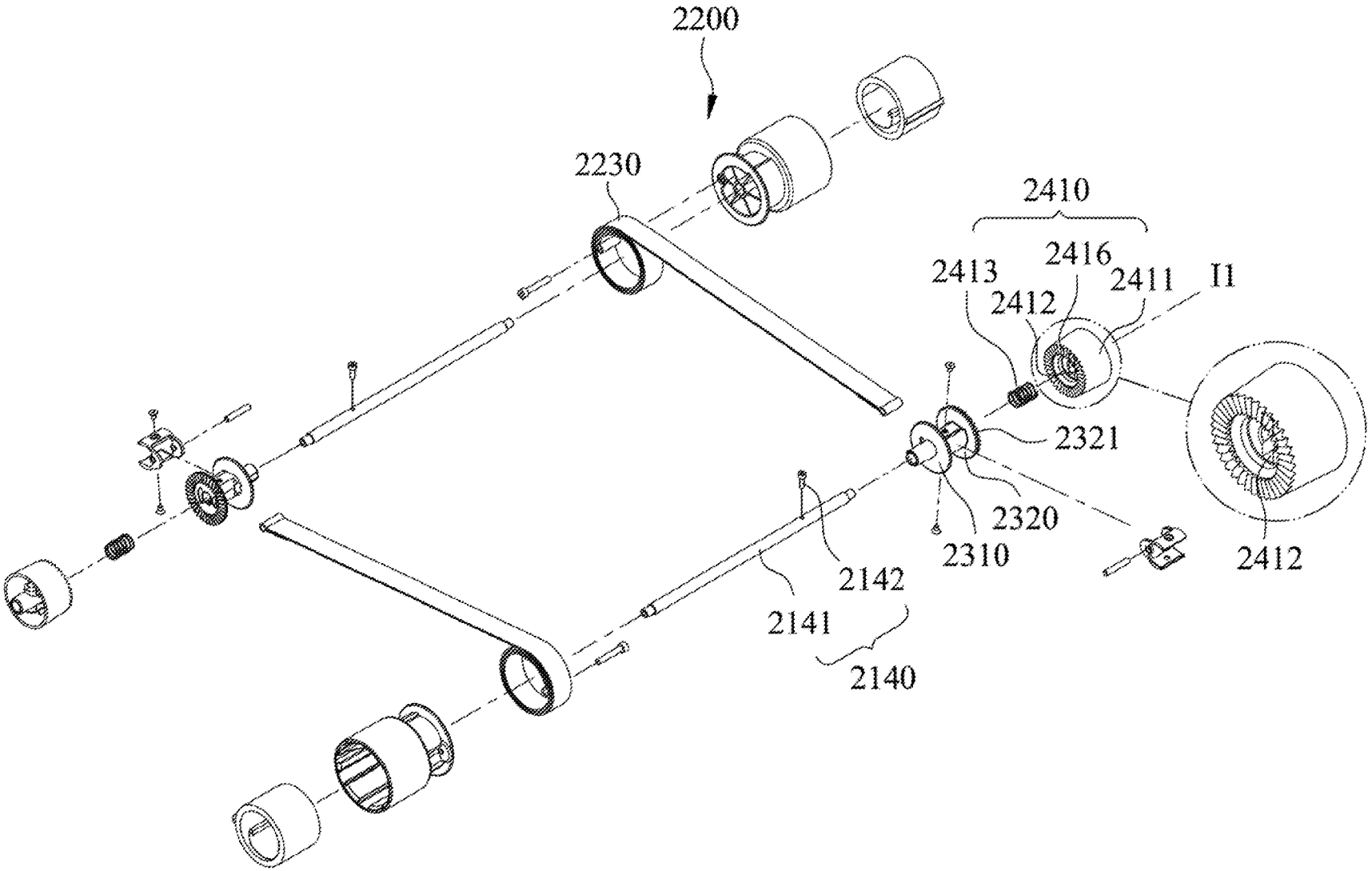
FIG. 6 shows one partial exploded view of an exercising device according to another embodiment of the present disclosure.
Figure 7:
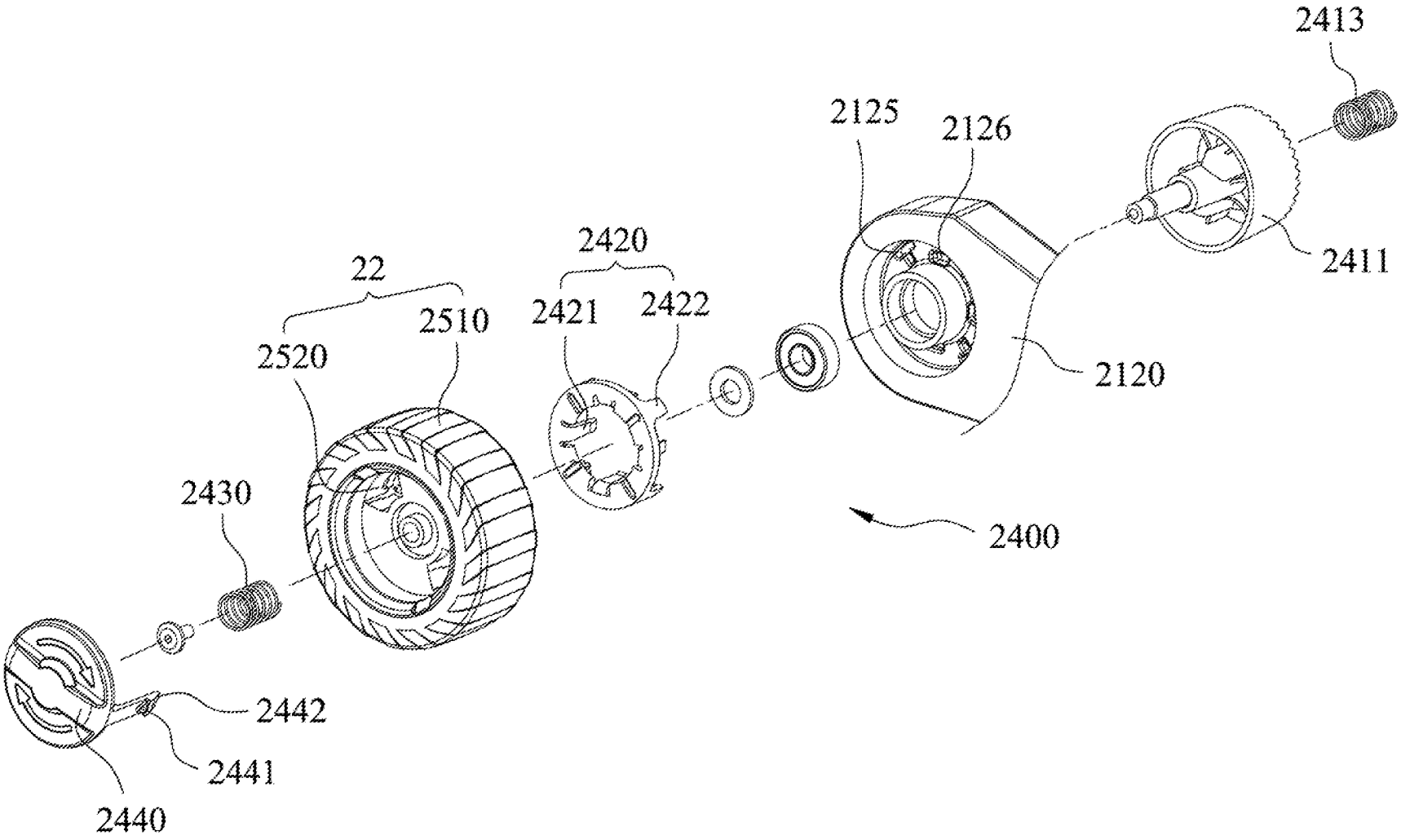
FIG. 7 shows another partial exploded view of the exercising device of the exercising device of FIG. 6.
Figure 8B:
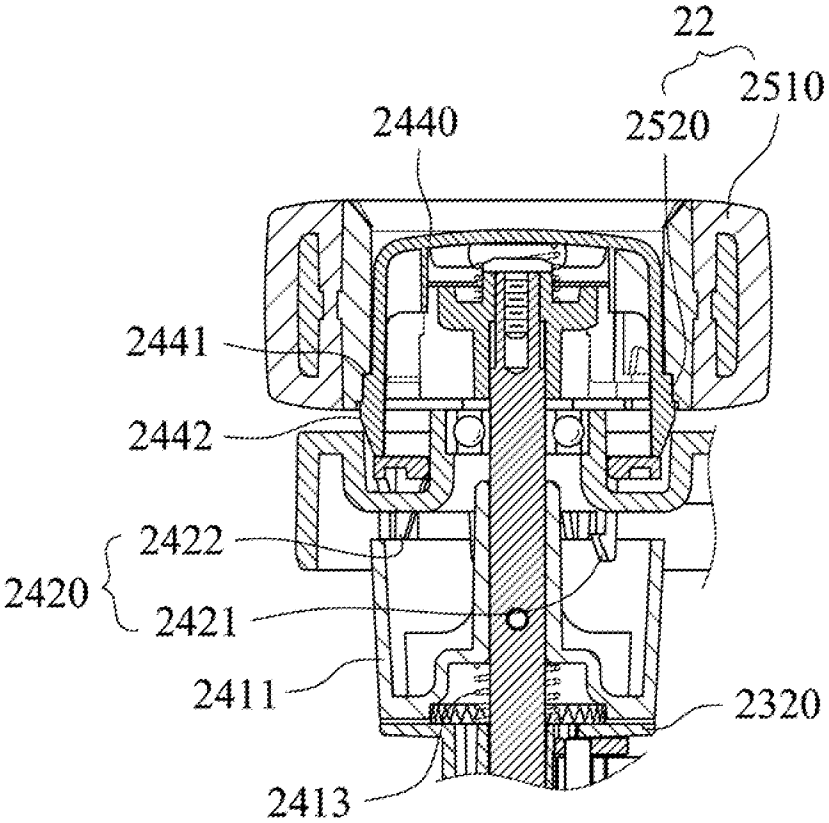
FIG. 8B shows another partial enlarged cross-sectional view of the exercising device of FIG. 6.
Figure 8A:
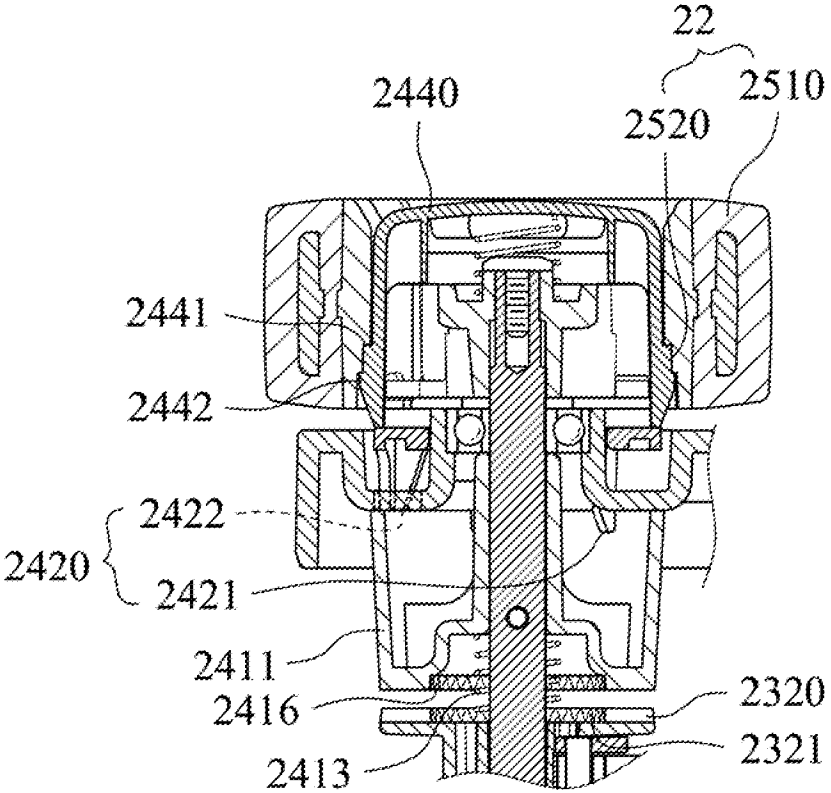
FIG. 8A shows one partial enlarged cross-sectional view of the exercising device of FIG. 6.

FIG. 6 shows one partial exploded view of an exercising device according to another embodiment of the present disclosure. FIG. 7 shows another partial exploded view of the exercising device of the exercising device of FIG. 6. FIG. 8A shows one partial enlarged cross-sectional view of the exercising device of FIG. 6. FIG. 8B shows another partial enlarged cross-sectional view of the exercising device of FIG. 6.

The exercising device in FIG. 6 is similar to the exercising device 10 in FIG. 1, but the structure of the connecting set 2400 is different. To be more specific, one of the wheels 22 which are disposed at the second axle 2140 includes a guiding groove 2520. The second axle 2140 includes an axel body 2141 and a positioning pin 2142. Two ends of the axle body 2141 are connected to two of the wheels 22, respectively. The positioning pin 2142 is protrudingly disposed at the axle body 2141 in a radial direction of one of the two wheels 22. The mounting assembly 2410 can further include a revolvable member 2411 with the mounting portion 2416, a limiting portion 2412, and a compression spring 2413. The limiting portion 2412 is positioned at the revolvable member 2411 and coupled to the positioning pin 2142. The compression spring 2413 is positioned between the revolvable member 2411 and the engaging plate 2320. The connecting set 2400 further includes a plug 2420 and a control knob 2440. The plug 2420 is positioned between the wheel 22 which includes the guiding groove 2520 and the revolvable member 2411 to push against the revolvable member 2411. The control knob 2440 is disposed at the wheel 22 that includes the guiding groove 2520 and includes a protruding arm 2442 and a slide 2441. The protruding arm 2442 passes through the wheel 22 that includes the guiding groove 2520 to push the plug 2420. The slide 2441 is disposed at the protruding arm 2442 and corresponds to the guiding groove 2520. Rotation of the control knob 2440 in a first direction (not shown) causes the slide 2441 to move along the guiding groove 2520 such that the protruding arm 2442 pushes the plug 2420 to urge the revolvable member 2411 and the mounting portion 2416 is located at the first position to engage with the engaging portion 2321. Rotation of the control knob 2440 in a second direction can switch the mounting portion 2416 to the second position.

The wheel 22 that includes the guiding groove 2520 can further include a wheel body 2510. The guiding groove 2520 is disposed at a wall surface of the wheel body 2510. The guiding groove 2520 is arc-shaped and is wound around the inner wall of the wheel body 2510 such that distances between different points of the guiding groove 2520 and the flange of the wheel body 2510 are different. The distance toward one end may increase. Hence, when rotating the control knob 2440, the slide 2441 will be guided by the guiding groove 2520 to move in the axial direction I1 such that the plug 2442 will also move in the axial direction I1. The plug 2420 is ring-shaped and includes a plurality of abutting arms 2442 and a plurality of limiting arms 2421. The frame 2120 includes a plurality of through holes 2124 and a plurality of aligning holes 2126. Each through hole 2124 is configured for each abutting arm 2422 to pass therethrough, and each of the aligning holes 2126 is configured for each limiting arm 2421 to pass therethrough and be limited thereby. The connecting set 2400 can further include a coil spring 2430 positioned between the control knob 2440 and the wheel 22 that includes the guiding groove 2520.

Therefore, as shown in FIG. 8A, in the initial state, the control knob 2440 is not operated, and the protruding arm 2442 of the control knob 2440 is pushed against the plug 2420. The abutting arm 2422 of the plug 2420 is pushed against the revolvable member 2411. Meanwhile, the compression spring 2413 is not compressed and the mounting portion 2416 is separated from the engaging portion 2321. Because the mounting portion 2416 is separated from the engaging portion 2321, rotation of the wheel 22 will not rotate the spool 2310 to wind or release the belt 2230; consequently, the restoring set 2200 cannot accumulate energy to provide the restoring force. On the other hand, when rotating the control knob 2440 in the first direction, the slide 2441 is guided by the guiding groove 2520 such that the protruding arm 2442 moves along the axial direction I1 to push the plug 2420. The abutting arm 2422 will push the revolvable member 2411 to compress the compression spring 2413. The mounting portion 2416 will be located at the first position and is coupled to the engaging portion 2321. Based on the engagement between the mounting portion 2416 and the engaging portion 2321, rotation of the wheel 22 causes the spool 2310 to wind or release the belt 2230 such that the restoring set 2200 can accumulate energy to provide the restoring force. If the user wants to disable the restoring set 2200, rotation of the control knob 2440 in the second direction can cause the exercising device to return to the state shown in FIG. 8A.

Figure 9:
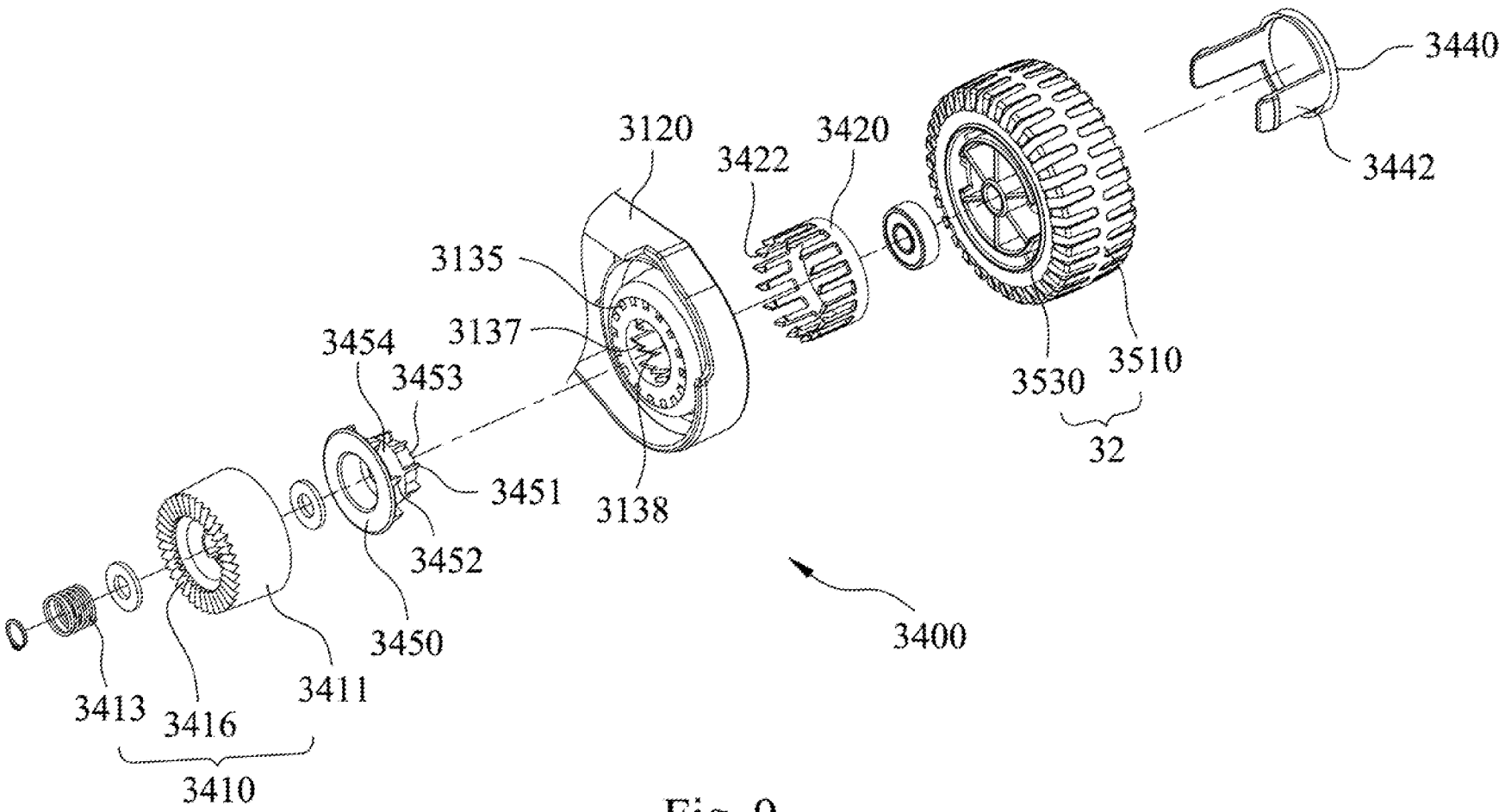
FIG. 9 shows a partial exploded view of an exercising device according to yet another embodiment of the present disclosure.
Figure 10B:
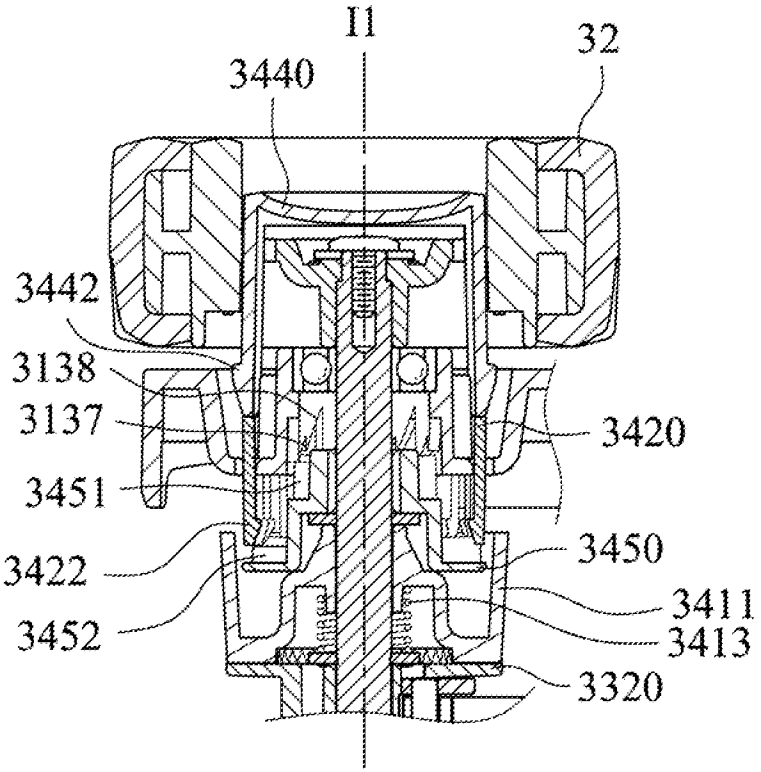
FIG. 10B shows another partial enlarged cross-sectional view of the exercising device of FIG. 9.
Figure 10A:
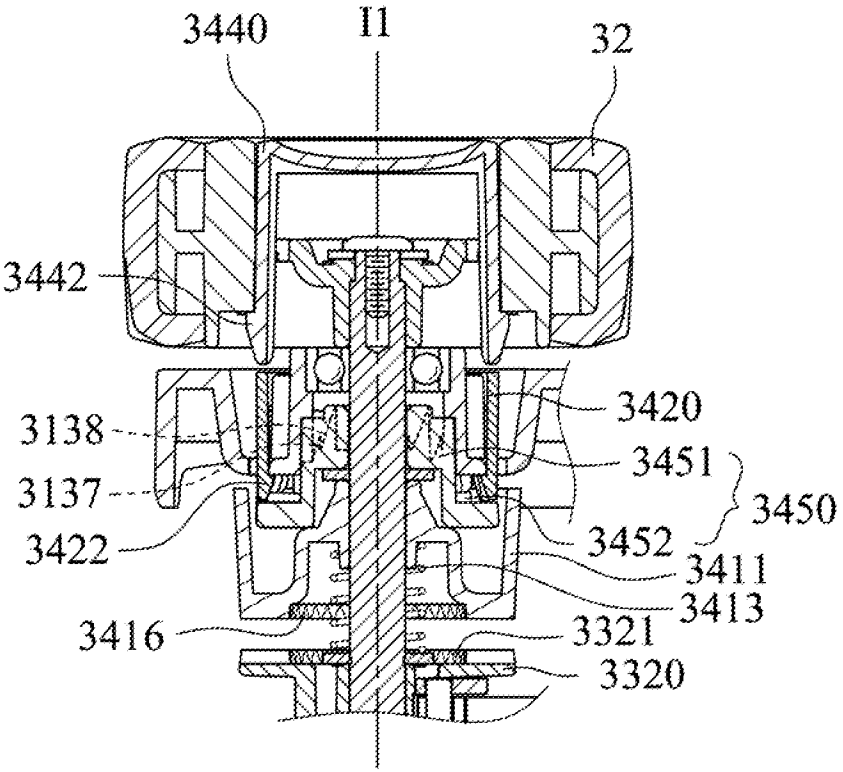
FIG. 10A shows one partial enlarged cross-sectional view of the exercising device of FIG. 9.

FIG. 9 shows a partial exploded view of an exercising device according to yet another embodiment of the present disclosure. FIG. 10A shows one partial enlarged cross-sectional view of the exercising device of FIG. 9. FIG. 10B shows another partial enlarged cross-sectional view of the exercising device of FIG. 9.

The exercising device shown in FIG. 9 is similar to the exercising device shown in FIG. 1, but the structure of the connecting set 3400 is different. To be more specific, one of the frames 3120 includes a first tier 3137 and a second tier 3138. One of the wheels 32 which are disposed at the second axle (not shown) includes a limiting member 3530. The second axle includes an axel body (not shown) and a positioning pin (not shown). Two ends of the axle body are connected to two of the wheels 32, respectively. The positioning pin is protrudingly disposed at the axle body in a radial direction perpendicular to the axial direction I1. The mounting assembly 3410 can further include a revolvable member 3411 with the mounting portion 3416, a limiting cave (not labeled), and a compression spring 3413. The limiting cave is positioned at the revolvable member 3411 and coupled to the positioning pin. The compression spring 3413 is positioned between the revolvable member 3411 and the engaging plate 3320. The connecting set 3400 further includes a switch barrel 3450, a plug 3420 and a control knob 3440. The switch barrel 3450 is positioned between the frame 3120 which includes the first tier 3137 and the second tier 3138 and the revolvable member 3411, and the switch barrel 3450 includes an abutting portion 3451 and an inclined portion 3452. The abutting portion 3451 is selectively coupled to the first tier 3137 or the second tier 3138. The plug 3420 is positioned between the wheel 32 which includes the limiting member 3520 and the frame 3120 that includes the first tier 3137 and the second tier 3138. The plug 3420 includes one or more abutting arms 3442 which can pass through the frame 3120 that includes the first tier 3137 and the second tier 3138 to push the inclined portion 3452. The control knob 3440 is disposed at the frame 3120 that includes the first tier 3137 and the second tier 3138 and includes one or more protruding arms 3442. The one or more protruding arms 3442 pass through the frame 3120 that includes the first tier 3137 and the second tier 3138 to push the plug 3420, and the one or more protruding arms 3442 are limited by the limiting member 3530. Pressing the control knob 3440 causes the one or more protruding arms 3442 to push the plug 3420, and the plug 3420 pushes the inclined portion 3452 to rotate the switch barrel 3450 such that the abutting portion 3451 are engaged with the first tier 3137 and the mounting portion 3416 is located at the first position to couple to the engaging portion 3321.

The wheel 32 that includes the limiting member 3530 can further include a wheel body 3510. The limiting member 3530 has a through hole structure and is through the wheel body 3510. When the control knob 3440 is disposed at the wheel 32 that includes the limiting member 3530, the protruding arm 3442 can pass through the limiting member 3530 and is limitedly movable in the axial direction I1 within the limiting member 3530.

The plug 3420 is ring-shaped and includes a plurality of abutting arms 3422 extended in the axial direction I1. The frame 3120 that includes the first tier 3137 and the second tier 3138 includes a plurality of through hole 3135, and each through hole 3135 is configured to allow each abutting arm 3442 to pass therethrough. The first tier 3137 is arranged near the second tier 3138. In the exercising device shown in FIG. 9, a plurality of the first tiers 3137 and a plurality second tiers 3138 are surrondingly disposed at an inner wall of an axial hole of the frame 3120. A maximum distance between the first tier 3137 and the flange of the wheel body 3510 in the axial direction I1 is smaller than a maximum distance between the second tier 3138 and the flange of the wheel body 3510 in the axial direction I1.

The switch barrel 3450 is barrel-shaped and includes a narrow segment 3453 and a wide segment 3454. The plurality of abutting portions 3451 are surroundingly disposed at the narrow segment 3453, and the plurality of inclined portion 3452 are surroundingly disposed at the wide segment 3454. Each inclined portion 3452 includes an inclined surface (not shown) corresponding to a tilt surface (not shown) of each abutting arm 3422. Accordingly, when the abutting arm 3442 pushes the inclined portion 3452, the tilt surface presses the inclined surface to allow the switch barrel 3450 to move in the axil direction I1 and rotate simultaneously such that the engagement between the abutting portion 3451 and the first tier 3137 or engagement between the abutting portion 3451 and the second tier 3138 will be changed.

As shown in FIG. 10A, in the initial state, the control knob 3440 is not operated, and the protruding arm 3442 of the control knob 3440 is pushed against the plug 3420. The abutting arm 3422 of the plug 3420 is pushed against the inclined portion 3452 of the switch barrel 3450, and the abutting portion 3451 is coupled to the second tier 3183. Meanwhile, the compression spring 3413 is not compressed, and the mounting portion 3416 is separated from the engaging portion 3321. Because the mounting portion 3416 is separated from the engaging portion 3321, rotation of the wheel 32 will not rotate the spool to wind or release the belt; consequently, the restoring set cannot accumulate energy to provide the restoring force. On the other hand, when pressing the control knob 3440 in the axial direction I1 to allow the protruding arm 3442 to push the plug 3420, the abutting arm 3442 will axially push the switch barrel 3450 to move and rotate. The abutting portion 3451 will couple to the first tier 3137 and the revolvable member 3441 will compress the compression spring 3413. The mounting portion 3416 will be located at the first position and couple to the engaging portion 3321. Based on the engagement between the mounting portion 3416 and the engaging portion 3321, rotation of the wheel 32 causes the spool to wind or to release the belt such that the restoring set can accumulate energy to provide the restoring force. If the user wants to disable the restoring set, pressing the control knob 3440 in the axial direction I1 can cause the exercising device to return to the state shown in FIG. 10A.

Figure 12:
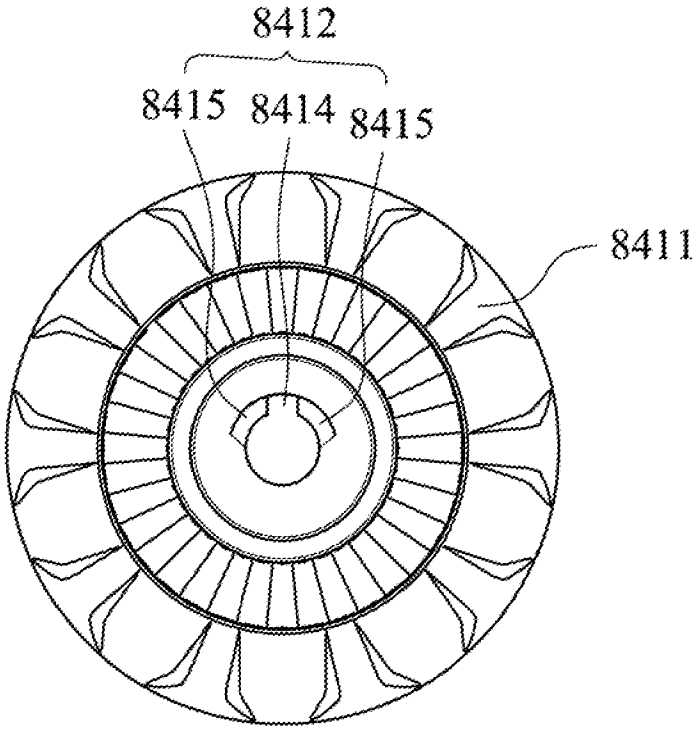
FIG. 12 shows a front view of the revolvable member of FIG. 11.
Figure 11:
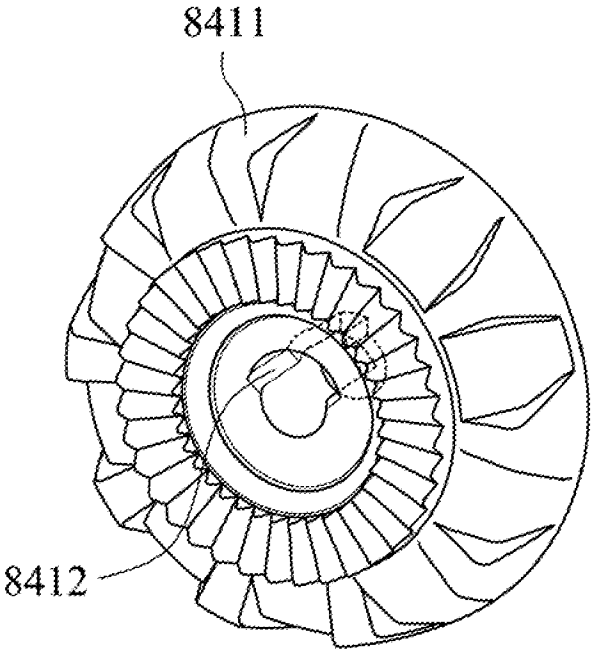
FIG. 11 shows a schematic three-dimensional view of a revolvable member of an exercising device according to still yet another embodiment of the present disclosure.
Figure 13B:
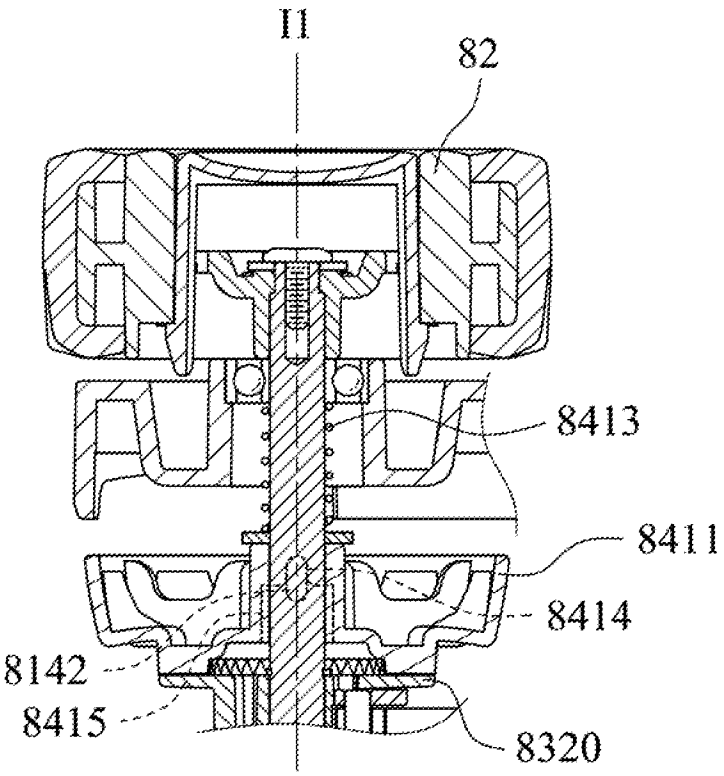
FIG. 13B shows another partial enlarged cross-sectional view of the exercising device of FIG. 11.
Figure 13A:
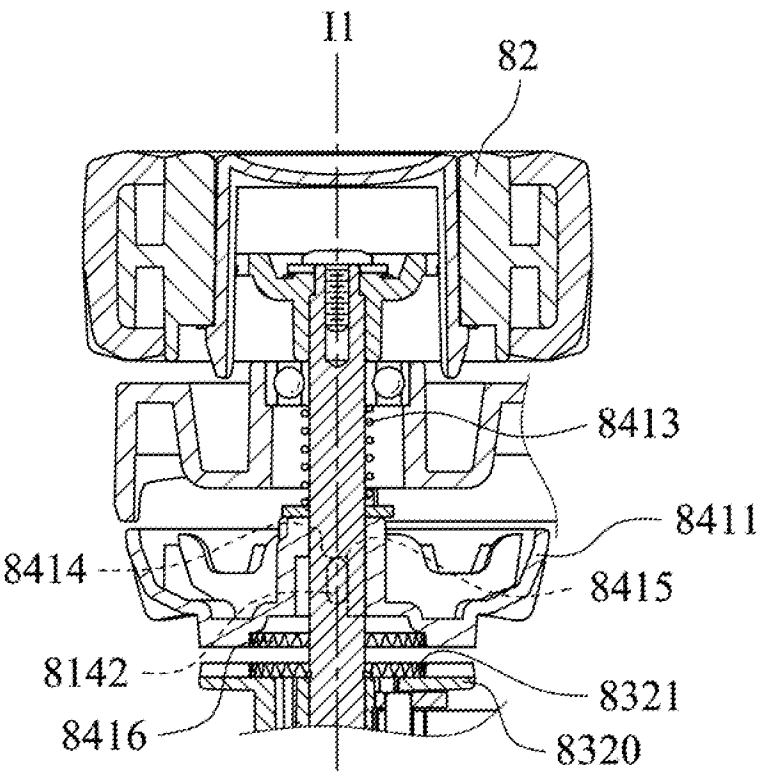
FIG. 13A shows one partial enlarged cross-sectional view of the exercising device of FIG. 11.

FIG. 11 shows a schematic three-dimensional view of a revolvable member of an exercising device according to still yet another embodiment of the present disclosure. FIG. 12 shows a front view of the revolvable member of FIG. 11. FIG. 13A shows one partial enlarged cross-sectional view of the exercising device of FIG. 11. FIG. 13B shows another partial enlarged cross-sectional view of the exercising device of FIG. 11.

The exercising device shown in FIGS. 11 to 13B is similar to the exercising device 10 shown in FIG. 1, but the structure of the revolvable member 8411 is different. Precisely, the limiting portion 8412 has a T-shaped groove structure. The limiting portion 8412 includes a first segment 8414 and two second segments 8415 connected to the first segment 8414. The first segment 8414 is extended in the axial direction I1, and the two second segments are extended in the radial direction and are located at two side of the first segment 8414, respectively.

Hence, as shown in FIG. 13A, when the positioning pin 8142 is located in anyone of the second segments 8415, the mounting portion 8416 is located at the second position and separated from the engaging portion 8321, and the revolvable member 8411 compresses the compression spring 8413 to allow the compression spring 8413 to accumulate energy. Because the mounting portion 8416 is separated from the engaging portion 8321, rotation of the wheel 82 cannot cause rotation of the spool; as a result, the belt cannot be wound or released and the restoring set cannot accumulate energy such that no restoring force can be provided. On the other hand, as shown in FIG. 13B, when rotation of the revolvable member 8411 causes the positioning pin 8142 to switch from the second segment 8415 to the first segment 8414, the mounting portion 8416 is switched to the first position and engaged with the engaging portion 8321. Based on the engagement between the mounting portion 8416 and the engaging portion 8321, rotation of the wheel 82 can cause rotation of the spool such that the belt is allowed to be wound or released, and the restoring set can accumulate energy to provide the restoring force.

Figure 14:
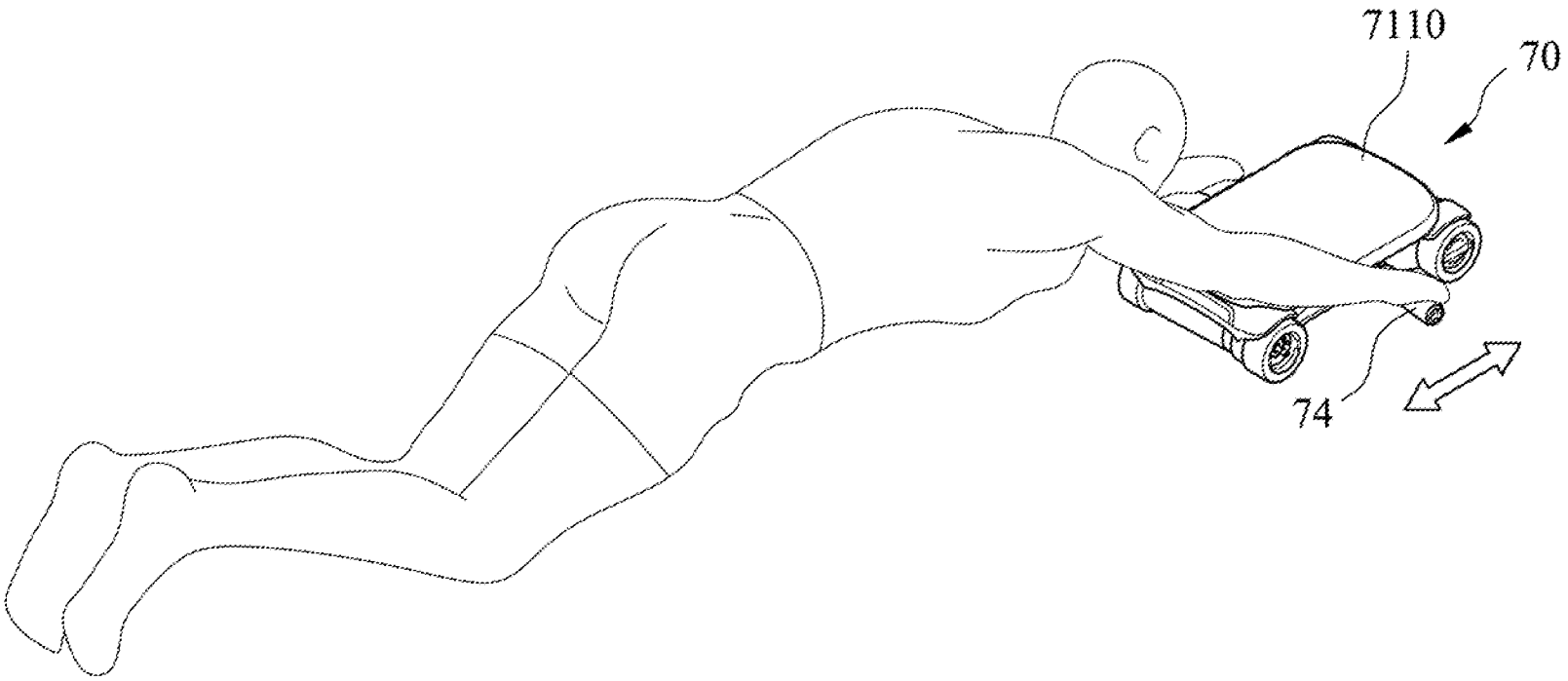
FIG. 14 shows one operation of an exercising device according to still yet another embodiment of the present disclosure.
Figure 15:
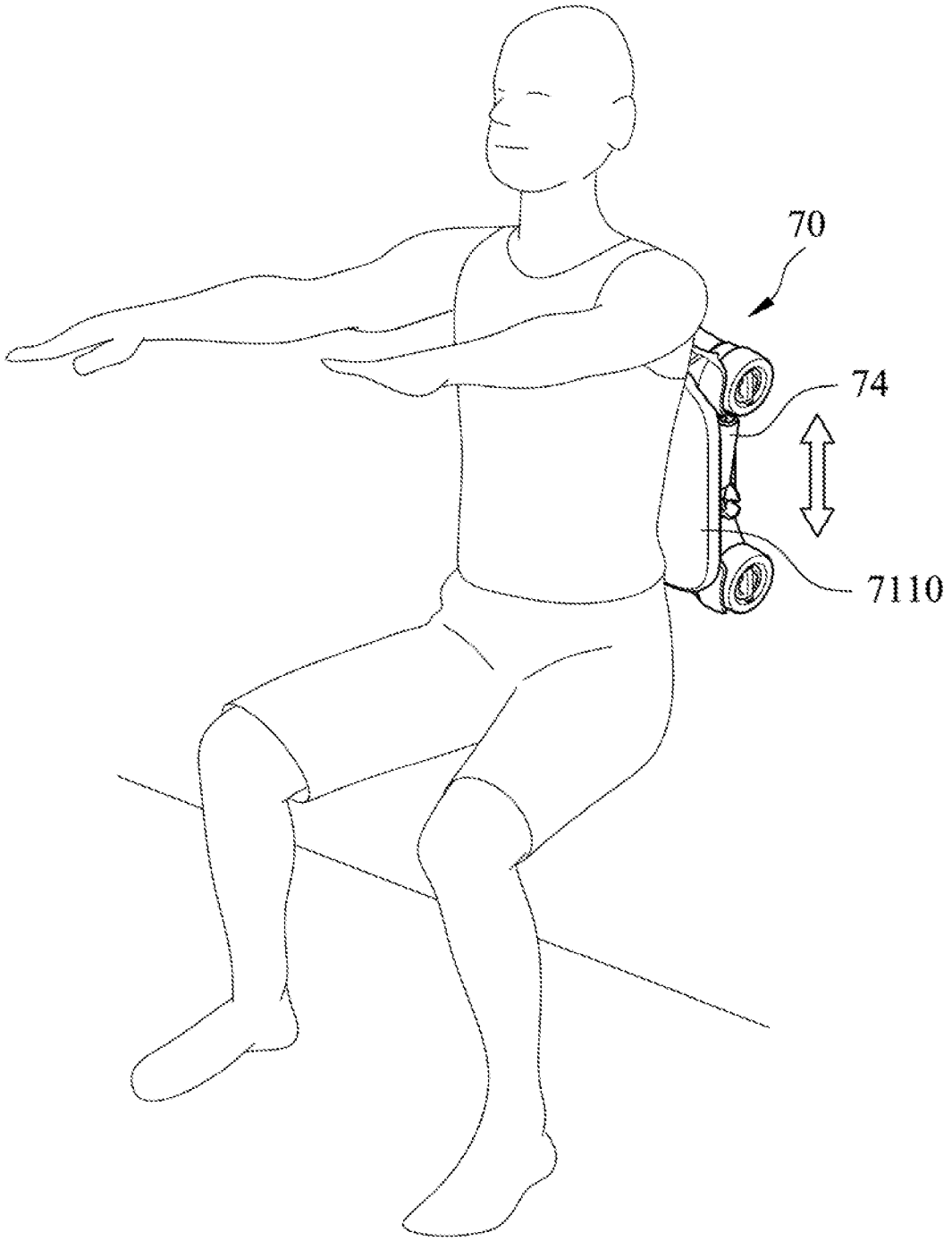
FIG. 15 shows another operation of an exercising device according to still yet another embodiment of the present disclosure.
Figure 16:
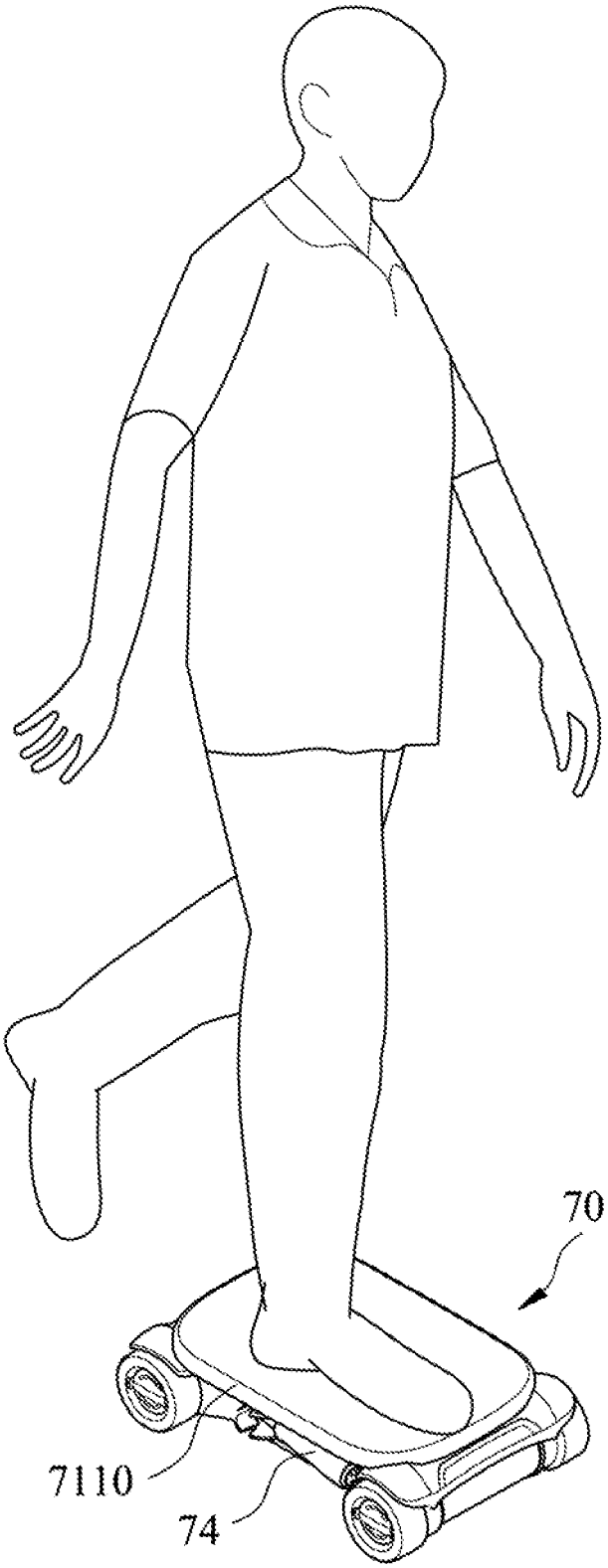
FIG. 16 shows yet another operation of an exercising device according to still yet another embodiment of the present disclosure.

FIG. 14 shows one operation of an exercising device 70 according to still yet another embodiment of the present disclosure. FIG. 15 shows another operation of an exercising device 70 according to still yet another embodiment of the present disclosure. FIG. 16 shows yet another operation of an exercising device 70 according to still yet another embodiment of the present disclosure. The exercising device 70 can be anyone of the exercising devices shown in FIGS. 1 to 13B. As shown in FIG. 14, the user can hold the handles to operate the exercising device 70 which is served as an abdominal exercising device. As shown in FIG. 15, the user can rest on the carrier 7110, and the exercising device 70 can be served as a balance exercising device. Moreover, in FIG. 14 and FIG. 15, the user can operate the connecting set to enable or disable the restoring mechanism. Additionally, the user can stand on the carrier 7110 and the exercising device 70 is served as the skateboard when the restoring mechanism is disabled.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A restoring mechanism for providing a restoring force to an exercising device, the exercising device comprising a fixing structure and a wheel, the restoring mechanism comprising:

a restoring set, comprising a fixed portion and a link-up portion, wherein the fixed portion is connected to the fixing structure;

a driving set connected to the link-up portion; and a mounting portion selectively coupled to the driving set;

wherein when the mounting portion is coupled to the driving set, rotation of the wheel causes the driving set to drive the restoring set such that the restoring set is configured to accumulate energy.

2. The restoring mechanism of claim 1, wherein, the restoring set further comprises:

a spiral spring comprising a jointed portion, wherein the fixed portion of the restoring set is a portion of the spiral spring; and a belt being connected to the jointed portion of the spiral spring, wherein the link-up portion of the restoring set is a portion of the belt; and the driving set comprises:

a spool connected to the link-up portion, the spool configured for the belt to wind therearound; and an engaging plate connected to one end the spool and comprising an engaging portion;

wherein the mounting portion is connected to the wheel and selectively coupled to the engaging portion, wherein the mounting portion switches between a first position and a second position in an axial direction of the wheel;

wherein when the mounting portion is located at the first position, the mounting portion is coupled to the engaging portion, and rotation of the wheel causes the belt to wind on the spool such that the spiral spring is configured to accumulate energy;

wherein when the mounting portion is located at the second position, the wheel does not link up with the driving set.

3. The restoring mechanism of claim 2, wherein the mounting portion comprises a plurality of protruding teeth, and the engaging portion comprises a plurality of depressions corresponding to the plurality of protruding teeth.

4. An exercising device, comprising:

a fixing structure;

one or more wheels disposed at the fixing structure; and one or more restoring mechanisms disposed at the fixing structure and comprising:

a restoring set, comprising a fixed portion and a link-up portion, wherein the fixed portion is connected to the fixing structure;

a driving set connected to the link-up portion; and a mounting portion selectively coupled to the driving set;

wherein when the mounting portion is coupled to the driving set, rotation of the one or more wheels causes the driving set to drive the restoring set such that the restoring set is configured to accumulate energy.

5. The exercising device of claim 4, wherein the fixing structure comprises:

a carrier;

two frames, one of the two frames disposed at one of two sides of the carrier, the other one of the two frames disposed at the other one of the two sides of the carrier; and a first axle and a second axle spaced apart from each other, each of the first axle and the second axle connected between the two frames;

wherein the one or more wheels comprise four wheels, two of the four wheels are disposed at the first axle, the other two of the four wheels are disposed at the second axle, and the fixed portion of the restoring set is connected to one of the two frames.

6. The exercising device of claim 5, wherein, the restoring set further comprises:

a spiral spring disposed at the first axle, the spiral spring comprising a jointed portion, wherein the fixed portion of the restoring set is a portion of the spiral spring;

a spring sleeve covering the spiral spring and connected to the jointed portion; and a belt with the link up portion bring wound around the spring sleeve, wherein the link-up portion of the restoring set is a portion of the belt; and the driving set comprises:

a spool disposed at the second axle and connected to the link-up portion, the spool configured for the belt to wind therearound; and an engaging plate connected to one end the spool and comprising an engaging portion;

wherein the mounting portion is disposed at the second axle and connected to the two wheels which are disposed at the second axle, and the mounting portion is selectively coupled to the engaging portion, wherein the mounting portion switches between a first position and a second position in an axial direction of one of the two wheels that are disposed at the second axle;

wherein when the mounting portion is located at the first position, the mounting portion is coupled to the engaging portion, rotation of the two wheels that are disposed at the second axle causes the belt to wind on the spool such that the spiral spring is configured to accumulate energy;

when the mounting portion is located at the second position, the two wheels that are disposed at the second axle do not link up with the driving set.

7. The exercising device of claim 6, wherein, the second axle comprises:

an axle body, wherein one of two ends of the axle body is connected to one of the two wheels that are disposed at the second axle, the other one of the two ends of the axle body is connected to the other one of the two wheels that are disposed at the second axle;

a positioning pin protrudingly and radially disposed at the axle body; and the exercising device further comprises:

a revolvable member with the mounting portion;

a limiting portion positioned at the revolvable member and coupled to the positioning pin, the limiting portion comprising a first segment and a second segment;

wherein when the positioning pin is located at the second segment, the mounting portion is located at the second position and separated from the engaging portion, and when the positioning pin is located at the first segment, the mounting portion is located at the first position to engage with the engaging portion.

8. The exercising device of claim 7, further comprising:

a compression spring located between the revolvable member and the frame;

wherein when the positioning pin is located at the second segment, the revolvable member causes compression of the compression spring, and the mounting portion is located at the second position and separated from the engaging portion, and when the positioning pin is located at the first segment, the compression spring is restored to push the engaging plate, and the mounting portion switches to the first position to engage with the engaging portion.

9. The exercising device of claim 6, wherein the mounting portion comprises a plurality of protruding teeth, and the engaging portion comprises a plurality of depressions corresponding to the plurality of protruding teeth.

10. The exercising device of claim 6, wherein, the second axle comprises:

an axle body, wherein one of two ends of the axle body is connected to one of the two wheels that are disposed at the second axle, the other one of the two ends of the axle body is connected to the other one of the two wheels that are disposed at the second axle;

a positioning pin protrudingly and radially disposed at the axle body;

a first wheel of the two wheels which are disposed at the second axle comprises a guiding groove;

the exercising device further comprises:

a revolvable member with the mounting portion;

a limiting portion positioned at the revolvable member and coupled to the positioning pin; and a compression spring positioned between the revolvable member and the engaging plate;

a plug positioned between the first wheel which comprises the guiding groove and the revolvable member to push against the revolvable member; and a control knob disposed at the first wheel that comprises the guiding groove and comprising:

a protruding arm passing through the first wheel that comprises the guiding groove to push the plug; and a slide disposed at the protruding arm and corresponding to the guiding groove;

wherein rotation of the control knob in a first direction causes the slide to move along the guiding groove such that the protruding arm pushes the plug to urge the revolvable member and the mounting portion is located at the first position to engage with the engaging portion; and rotation of the control knob in a second direction switches the mounting portion to the second position.

11. The exercising device of claim 6, wherein, one of the two frames comprises a first tier and a second tier;

the second axle comprises:

an axle body, wherein one of two ends of the axle body is connected to one of the two wheels that are disposed at the second axle, the other one of the two ends of the axle body is connected to the other one of the two wheels that are disposed at the second axle;

a positioning pin protrudingly and radially disposed at the axle body;

a first wheel of the two wheels which are disposed at the second axle comprises a limiting member;

the exercising device further comprises:

a revolvable member with the mounting portion;

a limiting cave positioned at the revolvable member and coupled to the positioning pin; and a compression spring positioned between the revolvable member and the engaging plate;

a switch barrel positioned between the frame which comprises the first tier and the second tier and the revolvable member, the switch barrel comprising an abutting portion and an inclined portion, wherein the abutting portion selectively coupled to the first tier or the second tier;

a plug positioned between the first wheel which comprises the limiting member and the frame that comprises the first tier and the second tier, the plug comprising:

one or more abutting arms passing through the frame that comprises the first tier and the second tier to push the inclined portion; and a control knob disposed at the frame that comprises the first tier and the second tier, the control knob comprising:

a protruding arm passing through the frame that comprises the first tier and the second tier to push the plug, the protruding arm limited by the limiting member;

wherein pressing the control knob causes the protruding arm to push the plug, the plug pushes the inclined portion to rotate the switch barrel such that the abutting portion is engaged with the first tier, and the mounting portion is located at the first position to couple to the engaging portion.

12. The exercising device of claim 5, wherein the one or more restoring mechanisms comprise two restoring mechanisms, the driving set of one of the two restoring mechanisms is disposed at the first axle, and the driving set of the other one of the two restoring mechanisms is disposed at the second axle.

13. The exercising device of claim 4, further comprises: two handles pivotally disposed at the fixing structure.

* * * * *